US008647468B2

(12) United States Patent
Heiskanen et al.

(10) Patent No.: US 8,647,468 B2
(45) **Date of Patent: *Feb. 11, 2014**

(54) PROCESS FOR PRODUCING MICROFIBRILLATED CELLULOSE

(75) Inventors: Isto Heiskanen, Imatra (FI); Kaj Backfolk, Lappeenranta (FI); Marianna Vehviläinen, Tampere (FI); Taina Kamppuri, Tampere (FI); Pertti Nousiainen, Tampere (FI)

(73) Assignee: Stora Enso OYJ, Helsinki (FI)

( * ) Notice: Subject to any disclaimer, the term of this patent is extended or adjusted under 35 U.S.C. 154(b) by 0 days.

This patent is subject to a terminal disclaimer.

(21) Appl. No.: 13/382,706

(22) PCT Filed: Jul. 2, 2010

(86) PCT No.: PCT/IB2010/053044

§ 371 (c)(1),
(2), (4) Date: Feb. 10, 2012

(87) PCT Pub. No.: WO2011/004301

PCT Pub. Date: Jan. 13, 2011

(65) Prior Publication Data

US 2012/0135506 A1 May 31, 2012

(30) Foreign Application Priority Data

Jul. 7, 2009 (SE) ..... 0950535

(51) Int. Cl.
*D21C 1/00* (2006.01)

(52) U.S. Cl.
USPC ..... 162/9; 162/24; 162/25; 162/28

(58) Field of Classification Search
USPC ..... 162/28, 24; 241/24.19
See application file for complete search history.

(56) References Cited

U.S. PATENT DOCUMENTS

| | | | | |
|---|---|---|---|---|
| 3,382,140 | A * | 5/1968 | Henderson et al. | 162/28 |
| 5,129,987 | A * | 7/1992 | Joachimides et al. | 162/25 |
| 6,425,975 | B1 * | 7/2002 | Viikari et al. | 162/29 |
| 7,297,224 | B2 * | 11/2007 | Nakamura et al. | 162/5 |
| 2006/0289132 | A1 | 12/2006 | Heijnesson-Hulten | |

FOREIGN PATENT DOCUMENTS

| | | | |
|---|---|---|---|
| WO | WO 0196402 | * | 12/2001 |
| WO | WO0196402 | | 12/2001 |
| WO | WO2004055268 | | 7/2004 |
| WO | WO2007091942 | | 8/2007 |
| WO | WO 2007091942 | A1 * | 8/2007 |

OTHER PUBLICATIONS

Yong Zou and Jeffery Hsieh, Review of Microfibrillated Cellulose for Papermaking, 2007, Pulp and Paper Engineering, School of Chemical and Biomolecular Engineering Georgia Institute of Technology, http://www.tappi.org/Downloads/Conference-Papers/2007/07NAN/07NAN18.aspx.*

Cellulase Analytical Method, 2011, Enzyme Development Corporation, http://www.enzymedevelopment.com/wp-content/uploads/2011/10/Cellulase-ECU-UNCO.pdf.*

Smook, Gary A. Handbook of Pulp and Paper Terminology, 1990, Angus Wilde Publications Inc., p. 131.*

Vehvilainen, Marianna; Kamppuri, Taina; Rom, Monika; Janicki, Jaroslaw; Ciechanska, Danuta; Gronqvist, Stina; Siika-Aho, Matti; Christoffersson, Kristina Elg; Nousiainen, Pertti. "Effect of Wet Spinning Parameters on the Properties of Novel Cellulose Fibres." Cellulose, (2008) vol. 15, No. 5, pp. 671-680.

Paakko, M; Ankerfors, M; Kosonen, H; Nykanen, A; Ahola, S; Osterberg, M; Ruokolainen, J; Laine, J; Larsson, P T; Ikkala, O; Lindstrom, T. "Enzymatic Hydrolysis Combined with Mechanical Shearing and High-Pressure Homogenization for Nanoscale Cellulose Fibrils and Strong Gels." Biomacromolecules (2007), vol. 8, No. 6, pp. 1934-1941.

Henriksson M; Henriksson G; Berglund, L A; Lindstrom, T. "An Environmentally Friendly Method for Enzyme-Assisted Preparation of Microfibrillated Cellulose (MFC) Nanofibers." European Polymer Journal, (2007), vol. 43, No. 8, pp. 3434-3441.

Svagan, A J; Samir, M A S A; Berglund L A. "Biometric Foams of High Mechanical Performance Based on Nanostructured Cell Walls Reinforced by Native Cellulose Nanofibrils." Advanced Materials (2008), vol. 20, No. 7, pp. 1263-1269.

* cited by examiner

*Primary Examiner* — Richard Crispino
*Assistant Examiner* — Eric Yaary
(74) *Attorney, Agent, or Firm* — Greer, Burns & Crain, Ltd.

(57) ABSTRACT

A process for treating cellulosic fibers comprising pre-treating the fibers with an enzyme in a first enzymatic treatment followed by mechanical pre-treating the fibers in a first mechanical treatment and a second enzymatic treatment followed by a second mechanical treatment of the fibers to form micofibrillated cellulose. In this way it is possible to produce mircofibrillated cellulose (MFC) in an improved and energy efficient way.

14 Claims, No Drawings

PROCESS FOR PRODUCING MICROFIBRILLATED CELLULOSE

This application is a U.S. National Stage under 35 U.S.C. §371 of International Application No. PCT/IB2010/053044, filed Jul. 2, 2010, which claims priority from Swedish Patent Application No. 0950535-5 filed Jul. 7, 2009.

FIELD OF THE INVENTION

The present invention relates to a process for producing microfibrillated cellulose by treating cellulosic fibers.

BACKGROUND

Cellulosic fibers are multi-component structures made from cellulose polymers, i.e. cellulose chains. Lignin, pentosans and other components known in art may also be present. The cellulose chains in the fibers are attached to each other to form elementary fibrils. Several elementary fibrils are bound to each other to form microfibrils and several microfibrils form aggregates. The links between the cellulose chains, elementary- and microfibrils are hydrogen bonds.

Microfibrillated cellulose (MFC) (also known as nanocellulose) is a material made from wood cellulose fibers, where the individual microfibrils have been partly or totally detached from each other. MFC is normally very thin (~20 nm) and the length is often between 100 nm to 1 μm.

MFC can be produced in a number of different ways. It is possible to mechanically treat cellulosic fibers so that microfibrils are formed. However, it is very energy consuming method to, for example, shred or refine the fibers and it is therefore not often used.

The production of nanocellulose or microfibrillated cellulose with bacteria is another option. In contrast to the above, this is a bio-synthetic process starting from another raw material than wood fibers. However, it is a very expensive process and time consuming.

It is also possible to produce microfibrils from cellulose by the aid of different chemicals which will break or dissolve the fibers. However, it is difficult to control the length of the formed fibrils and the fibrils are often too short.

One example of production of MFC is described in WO2007091942. In the method described in WO20070912942, the MFC is produced by the aid of refining in combination with addition of an enzyme.

One common problem with the techniques according to prior art is that the process conditions are not favourable for scale-up or large industrial applications requiring high quantities.

Thus, there is a need for an improved process for the production of microfibrillated cellulose.

SUMMARY OF THE INVENTION

It is an object of the present invention to provide a process for production of microfibrillated cellulose in an improved and energy efficient way.

Another object of the present invention is to produce microfibrillated cellulose with high consistency.

These objects and other advantages are achieved by the process according to claim 1. By alternating enzymatic treatments with mechanical treatments as described in claim 1 it is possible to produce microfibrillated cellulose (MFC) in a very energy efficient way. Furthermore, it is possible to increase the consistency of the produced MFC which provides clear benefits in terms of handling, dosing, drying or delivering the MFC to another user. This is achieved by the independent claim and preferred embodiments of the process are defined in the dependent claims.

The invention relates to a process for treating cellulosic fibers which process comprises pre-treatment of the fibers with an enzyme in a first enzymatic treatment followed by mechanical pre-treatment of the fibers in a first mechanical treatment. Thereafter, the fibers are treated with an enzyme in a second enzymatic treatment followed by a final mechanical treatment of the fibers in a second mechanical treatment to form microfibrillated cellulose. In this way it is possible to produce MFC in an improved and energy efficient way.

The activity of the enzyme during the first enzymatic treatment can be between 0.01-250 nkat/g, however the activity of the first enzymatic treatment is preferably low, preferably between 0.05-50 nkat/g and the activity of the enzyme during the second enzymatic treatment is preferably higher, preferably between 50-300 nkat/g.

The first mechanical treatment and the second mechanical treatment are preferably done by shredding or refining of the fibers. The first mechanical treatment opens the fiber structure before the following treatment with the enzyme. In this way the second enzymatic treatment will be more effective and selective which also will improve the second mechanical treatment and thus also the production of MFC.

The fibers are preferably mechanically treated at a consistency of between 2-40% by total weight. The fibers are preferably mechanically pre-treated in the first mechanical treatment at a high consistency of between 15-40% by total weight. It has been shown that mechanical pre-treatment of the fibers at high consistency reduces the amounts of fines. The fibers are thereafter preferably mechanically treated in the second mechanical treatment at a consistency of between 15-40% by total weight.

The pH during the first and/or second mechanical treatment is preferably above 9. The increase of pH during the mechanical treatment has been shown to decrease the energy needed.

The enzyme used during the first and/or the second enzymatic treatments is preferably affecting hemicellulose, such as xylanase or mannanase or an enzyme affecting cellulose, such as cellulase. The enzyme used in the process will decompose the cellulosic fibers and increase the accessibility and activity of the fibers and thus also the production of microfibrillated cellulose.

The cellulosic fibers are preferably fibers of kraft pulp.

DETAILED DESCRIPTION

The invention relates to a process for producing microfibrillated cellulose in an improved and energy efficient way. Furthermore, it is possible to produce MFC with a high consistency.

It has been shown that the combination of a first enzymatic treatment followed by a first mechanical treatment and a second enzymatic treatment activates and opens up the fiber structure in an improved way. Moreover, it has been shown that a second mechanical treatment of the treated fibers can be done in order to produce microfibrillated cellulose. By this process it is possible to produce MFC in a controlled and cost efficient way and also to produce MFC with a high consistency.

It has been shown that a first enzymatic treatment of cellulosic fibers followed by a first mechanical treatment, preferably at a high consistency, can increase the cutting of the fibers but while the production of fines is kept low. It is preferred to keep the amount of fines at a minimum after the first mechanical treatment, since enzymes which will be added in the second enzymatic treatment first decomposes fines before they decompose the fibers. Consequently, a low amount of fines increases the efficiency of the second enzymatic treatment.

The first enzymatic treatment as well as the second enzymatic treatment are done in order for the enzymes to decompose the cellulosic fibers and improve the production of MFC. The enzyme will decompose the primary layer of the fibers and thus increase the accessibility of the fibers and is then able to penetrate the fiber structure and get in between the fibrils. By the enzymatic treatments it is possible to reduce the extension of the mechanical treatments. A mechanical treatment of cellulosic fibers might strongly reduce the strength of the fibers and it is therefore advantageous to decrease the extent of such treatment as much as possible. By treating the fibers with enzymes before both mechanical treatments it is possible to avoid any unnecessary decrease in the strength of the fibers since the duration of the mechanical treatments can be decreased and the mechanical treatments can be done in a more gentle way.

The enzyme used in the first and second treatment can be any wood degrading enzymes which decompose cellulosic fibers. Cellulase is preferably used but other enzymes, for example enzymes which break down hemicellulose, such as xylanase and mannanase, may also be used. The same or different enzyme can be used in the two enzymatic treatments. The enzyme is often an enzymatic preparation which can contain small parts of other enzymatic activities than the main enzyme of the preparation.

Enzyme is added to the fibers which are in the form of a slurry which has a concentration of approximately 4-5%. The enzyme is added during stirring either in the beginning of the first and/or second treatment or during the entire reaction time.

The temperature used for the treatments with the enzyme may be between 30-85° C. However, the temperature depends on the enzyme used and the optimal working temperature for that specific enzyme as well as other parameters of the treatment, such as time and pH. If cellulase is used, the temperature during the treatment may be approximately 50° C.

The first and second enzymatic treatments may each last for 30 minutes-5 hours. The time needed depends on the cellulosic fibers which are treated and on the activity of the enzyme as well as the temperature of the treatment.

The enzymatic treatments can be terminated by either rising the temperature or the pH in order to denaturate the enzymes. The pH during the treatment with the enzyme is preferably between 4-6.

The activity of the enzyme during the first treatment can be between 0.01-250 nkat/g, preferably between 0.05-50 nkat/g. The target with the first enzymatic treatment is only to weaken or decompose the top surface of the fibers. Consequently, the activity of the enzyme is preferably low so that the fibers are not decomposed too much. The activity of the enzyme during the second enzymatic treatment is preferably between 50-300 nkat/g. The second enzymatic treatment is done in order to decompose the primary layer of the fibers as previously discussed, i.e. not only the top surface. Consequently, the activity of the enzyme during the second enzymatic treatment needs to be higher than during the first enzymatic treatment.

After the first enzymatic treatment, the cellulosic fibers are mechanically pre-treated in a first mechanical treatment. The fibers are preferably shredded or refined in order to increase the specific surface area of the fibers and in this way facilitate and improve the effect of the second enzymatic treatment. The shredding or refining may be done at a consistency between 2-40% by total weight. However, high consistency, preferably between 15-40%, or between 10-20% by total weight is often preferred. Low consistency, for example 2-6% by total weight or medium consistency, for example 10-20% of total weight can also be used.

The fines after the first mechanical treatment may be separated for example by fractionating the treated fibers, and the longer fibers can thus be further treated in the second enzymatic and mechanical treatments.

The first mechanical treatment is preferably done at a consistency of between 15-40% by total weight. It has been shown that treating cellulosic fibers with a first enzymatic treatment with quite low enzymatic activity followed by mechanical treatment at high consistency may increase fiber cutting, i.e. fibers with reduced fiber length are produced, while the amount of fines is kept at a minimum compared to other mechanical treatments. If large amount of fines are present during an enzymatic treatment the enzymes will first decompose them and not the fibers which are the target for the enzymatic treatment. Consequently, the first enzymatic and mechanical treatments will increase the efficiency of the second enzymatic treatment and thus also the efficiency of the second mechanical treatment and the production of MFC. Furthermore, by reducing the fiber length, the runnability during high consistency mechanical treatments increases. By the possibility to increase the consistency during mechanical treatments, even less fines will be produced and the internal fibrillation, which will make the fiber surface more open for the enzymes to penetrate, is improved.

Other mechanical pre-treatments besides refining and shredding, such as beating, steam explosion, defibration, homogenization, ultrasonic treatment, dry cutting or other known mechanical fiber treatments in order to soften the fibers and make them more active and reactive before the following treatments can also be used.

After the first mechanical treatment, an enzyme is once again added to the fibers which are in the form of a slurry which has a concentration of approximately 4-5%. The enzyme is added during stirring either in the beginning of the second enzymatic treatment or during the entire reaction time. The second treatment with the enzyme increases the accessibility and the activity of the fibers and improves the following mechanical treatment to form MFC.

The fibers are thereafter mechanically treated in a second mechanical treatment in order to form microfibrillated cellulose. The time and temperature during such treatment varies depending on the fibers treated as well as on the previous treatments and are controlled in order to receive fibers with the desired fiber length. The second mechanical treatment may be done by a refiner, defibrator, beater, friction grinder, high shear fibrilator (such as cavitron rotor/stator system), disperger, homogenizator (such as micro fluidizer) or other known mechanical fiber treatment apparatus. Usually the consistency of the fibers during treatment in a micro fluidizer can not be too high. However, exposing the fibers to high pressure in narrow capillary at high consistency will also result in high mechanical impact on the fibers and the fibers can be treated at a high consistency in a micro fluidizer according to the process described in claim 1.

The consistency of the fibers during the mechanical treatment is preferably between 2-40% by total weight. It is preferred to have a high consistency during the second mechanical treatment, preferably between 15-40% by total weight. The produced MFC will thus also have high consistency, preferably above 15% by total weight or preferably between 15-40% by total weight or even more preferably between 15-25% by total weight. In this way it is possible to transport the MFC to the site of usage in a very concentrated form. If needed it is possible to add water or chemical in order for the produced MFC to swell and thus make sure that all microfibrils are separated in the water or chemical. Addition of water during the second mechanical treatment should be avoided since the MFC will swell and it might be difficult to remove the produced MFC from the refiner, shredder or other mechanical treatment apparatus.

The pH during the first and/or second mechanical treatment is preferably above 9, even more preferably above 10. The increase of pH during the mechanical treatment has been shown to increase the efficiency of the mechanical treatment and thus decrease the energy needed.

It is also possible to add chemicals which will change the fiber to fiber friction or the swelling of the fibers during the process according to claim 1. Friction decreasing chemicals can for example be carboxymethylcellulose (CMC), starch or different polymers such as poly acrylamide (PAM) or surface active agents. Friction increasing chemicals may be fillers such as talc, calcium carbonate, kaolin or titanium dioxide etc. Chemicals which increases or decreases swelling of fibers can for example be sodium hydroxide, other pH changing chemicals, different salts or charged polymers. These chemicals are preferably added after the second enzymatic treatment before the second mechanical treatment. However, it is also possible to add chemicals before or during the first mechanical treatment. Another reason for adding e.g. polymers is to stabilize the fibrils.

The cellulosic fibers used in the process according to the invention are preferably fibers of kraft pulp, i.e. they have been treated according to the kraft process. It has been shown that the primary wall of the fibers in kraft pulp often prevents the fibers from forming fibrils. Thus, it is necessary to remove the primary wall. The primary wall of the fibers can be removed by increasing the pre-treatment of the fibers. Thus, increased refining, preferably high consistency refining, has been shown to be very effective. Also, enzymes affecting hemicellulose can be used, either alone or in combination with refining, preferably high consistency refining. It has been shown that the combination of enzymatic pre-treatment, mechanical pre-treatment, enzymatic treatment and a mechanical treatment as described in claim 1 is very effective when it comes to removing the primary walls of cellulosic fibers. However, other chemical pulps, mechanical pulps or chemi-mechanical pulps can also be used, one example is sulphite pulp. The fibers can also be bleached or unbleached. Fibres with thin fiber walls are preferably used.

The cellulosic fibers may be hardwood and/or softwood fibers. It has been shown that sulphite pulps and pine kraft pulp disintegrate into smaller fractions when treated according to the invention compared to eucalyptus and birch kraft pulps. Thus, it is preferred to treat softwood fibers with the process according to the invention.

The produced MFC has very good bonding properties, i.e. it bonds well to different material such as glass, aluminium, paper or wood. Thus the MFC can be used for the production of films. Another advantage with the produced MFC is that it can be used as a priming agent between different materials such as bio-barrier and fiber based substrate.

Micro fibrillated cellulose (MFC) is often also referred to as nanocellulose. Fibres that has been fibrillated and which have microfibrills on the surface and microfibrils that are separated and located in a water phase of a slurry are included in the definition MFC.

The invention claimed is:

1. A process for treating cellulosic fibers said process comprising:

pre-treating the fibers with an enzyme in a first enzymatic treatment wherein the enzyme during the first enzymatic treatment has an activity of 0.01-250 nkat/g, mechanically pre-treating the fibers in a first mechanical treatment at a consistency of between 15-40% by total weight, treating the fibers with an enzyme in a second enzymatic treatment wherein the enzyme during the second enzymatic treatment has an activity of 50-300 nkat/g, and wherein the activity of the enzyme during the second enzymatic treatment is higher than the activity of the enzyme during the first enzymatic treatment, and mechanically treating the fibers in a second mechanical treatment to form microfibrillated cellulose at a consistency of between 15-40% by total weight.

2. The process according to claim 1 wherein the fibers are mechanically treated by shredding or refining.

3. The process according to claim 1 wherein the pH is above 9 during the first mechanical step.

4. The process according to claim 1 wherein the enzyme used during the first enzymatic treatment is an enzyme affecting hemicellulose or an enzyme affecting cellulose.

5. The process according to claim 1 wherein the fibers are fibers of kraft pulp.

6. The process according to claim 1 wherein the enzyme during the first enzymatic treatment has the activity of 0.5-50 nkat/g.

7. The process according to claim 1 wherein the pH is above 9 during the second mechanical step.

8. The process according to claim 1 wherein the pH is above 9 during both the first and the second mechanical steps.

9. The process according to claim 1 wherein the enzyme used during the second enzymatic treatment is an enzyme affecting hemicellulose or an enzyme affecting cellulose.

10. The process according to claim 1 wherein the enzyme used during both the first and the second enzymatic treatment is an enzyme affecting hemicellulose or an enzyme affecting cellulose.

11. The process according to claim 4 wherein the enzyme affecting hemicellulose is xylanase or mannanase or the enzyme affecting cellulose is cellulase.

12. The process according to claim 9 wherein the enzyme affecting hemicellulose is xylanase or mannanase or the enzyme affecting cellulose is cellulase.

13. The process according to claim 10 wherein the enzyme affecting hemicellulose is xylanase or mannanase or the enzyme affecting cellulose is cellulase.

14. The process according to claim 1 further comprising adding at least one chemical to change the fiber to fiber friction or to change the swelling of the fibers.

* * * * *